US008277720B2

(12) United States Patent
Axelsson et al.

(10) Patent No.: US 8,277,720 B2
(45) Date of Patent: Oct. 2, 2012

(54) DEVICE AND METHOD FOR HEATING A METAL MATERIAL

(75) Inventors: Carl-Lennart Axelsson, Tungelsta (SE); Ola Ritzen, Akersberga (SE); Anders Lugnet, Rimbo (SE); Mattias Ekblom, Vasteras (SE)

(73) Assignee: AGA AB, Lidingo (SE)

( * ) Notice: Subject to any disclaimer, the term of this patent is extended or adjusted under 35 U.S.C. 154(b) by 191 days.

(21) Appl. No.: 12/677,905

(22) PCT Filed: Sep. 12, 2008

(86) PCT No.: PCT/SE2008/051022

§ 371 (c)(1),
(2), (4) Date: Jun. 2, 2010

(87) PCT Pub. No.: WO2009/035408

PCT Pub. Date: Mar. 19, 2009

(65) Prior Publication Data

US 2011/0187031 A1 Aug. 4, 2011

(30) Foreign Application Priority Data

Sep. 14, 2007 (SE) ..... 0702051

(51) Int. Cl.
*C21D 1/00* (2006.01)

(52) U.S. Cl. ..... 266/44; 266/103; 266/78

(58) Field of Classification Search ..... 266/44, 266/103, 78, 249; 148/657
See application file for complete search history.

(56) References Cited

U.S. PATENT DOCUMENTS

2007/0122756 A1 5/2007 Wunning et al.
2011/0187031 A1* 8/2011 Axelsson et al. ..... 266/44

FOREIGN PATENT DOCUMENTS

WO 2006/008169 1/2006
WO 2007/075138 7/2007

OTHER PUBLICATIONS

International Search Report dated Jan. 14, 2009, from corresponding PCT application.

* cited by examiner

*Primary Examiner* — Scott Kastler
(74) *Attorney, Agent, or Firm* — Young & Thompson

(57) ABSTRACT

Device for heating metal material includes an elongated DFI burner arranged to be driven with gaseous oxidant and gaseous fuel and to be displaceable and longitudinally arranged with respect to the metal material. The burner includes longitudinal tubular vessels for fuel and for oxidant, arranged in parallel to one another and relative to the surface of the metal material. Each of these vessels has an opening through which the fuel and oxidant flow out and then converge in an ignition zone outside the respective vessels, where a flame is generated. Supply devices are arranged via a regulator to keep the pressure constant throughout the respective vessel during operation. Each of the vessels has a longitudinally displaceable piston for controlling the longitudinal extension of the flame in the longitudinal direction of the vessels.

18 Claims, 3 Drawing Sheets

DEVICE AND METHOD FOR HEATING A METAL MATERIAL

The present invention relates to a device and a method for heating a metal material, for example in an industrial furnace. More particularly, the present invention relates to heating by means of so-called DFI (Direct Flame Impingement) technology. In other words a combustion flame is used which directly impinges the surface of the metal material, thereby efficiently transmitting thermal energy to the material.

When DFI technology is used to heat metal material, contaminants are removed from the surface of the material, which is also provided with an attractive surface structure for subsequent process stages.

In such DFI heating of metal material it is normal to allow a flame to move over the surface of the metal material. In continuous operation, metal material can for example be conveyed through a furnace and in so doing pass one or more stationary DFI burners, and be heated. Sometimes simultaneous heating over a certain width of a metal material is required. This often applies, for example, to the heating of strip, plate or wide slabs. This is achieved conventionally by placing several DFI burners, arranged at mutually regular intervals, along the width of the metal surface. The DFI burners thereby form a burner ramp past which the material is guided to be heated. Such a burner ramp is described in the Swedish patent application with number 0502913-7, which is incorporated herein by reference.

However, the heat transmission from a DFI burner decreases with the distance between the burner and the material surface. This may result in uneven temperature distribution over the burner ramp with lower heat transfer between than directly under the burner. This in turn gives the material an irregular surface in terms of crystallisation and temperature. To avoid these effects the distance between the burners and the material is required to be increased, which reduces the possibility of benefiting from the advantages of DFI technology described above.

Furthermore it is often desirable to adjust the width of the part of the ramp that heats the metal material, for example to avoid unnecessary heating outside the width of the metal material or local overheating in the edge sections of the material, as well as to compensate for lateral movements of the material as it moves forwards. However, it is difficult to achieve satisfactory precision with such adjustment if a ramp with several burners is used, because the adjusting means available involve adjusting down and/or shutting off individual burners. The width cannot therefore be adjusted in smaller steps than the distance between two burners.

Moreover, every burner added increases design and maintenance costs, which is why ramps with several burners are relatively expensive. Several burners require a large number of supply pipes for the fuel and oxidant, as well as more complicated and therefore more expensive valve and control systems.

The present invention solves the problems described above.

The present invention thus relates to a device for heating a metal material with a longitudinal direction and with a transverse direction perpendicular to the longitudinal direction, comprising an elongated burner device of the DFI type arranged to be driven with a gaseous oxidant and gaseous fuel, where the metal material and the burner device are arranged to be displaced relative to one another in the longitudinal direction, and where the device comprises one supply device for fuel and one supply device for oxidant, and is characterised in that the burner device comprises an elongated, tubular fuel vessel and an elongated, tubular oxidant vessel, in that the respective vessels are arranged in parallel to each other and to the surface of the metal material, in that they each comprise one or more openings arranged along the vessel through which the fuel and oxidant, respectively, are arranged to flow out and then converge in an ignition zone outside the respective vessels, where a flame is generated, in that the respective supply devices are arranged, by means of a regulator, to keep the pressure in each respective vessel constant throughout the vessel in question during operation, and in that each respective vessel comprises a piston, which is arranged to be able to be displaced in the longitudinal direction of the vessel and hence prevent fuel and oxidant respectively from flowing out through openings along the longitudinal section, which openings the piston temporarily screens from admission of the fuel and oxidant, so that the extension of the flame in the longitudinal direction of the vessels thereby can be controlled.

The invention will now be described in detail with reference to exemplary embodiments of the invention and the attached drawings, in which:

FIG. 2 shares the reference numbers for corresponding parts with FIG. 1.

FIG. 1 illustrates diagrammatically an industrial furnace 1 of the present invention. It may be designed for continuous heating of an elongated metal material or for batch operation.

Figure 1:
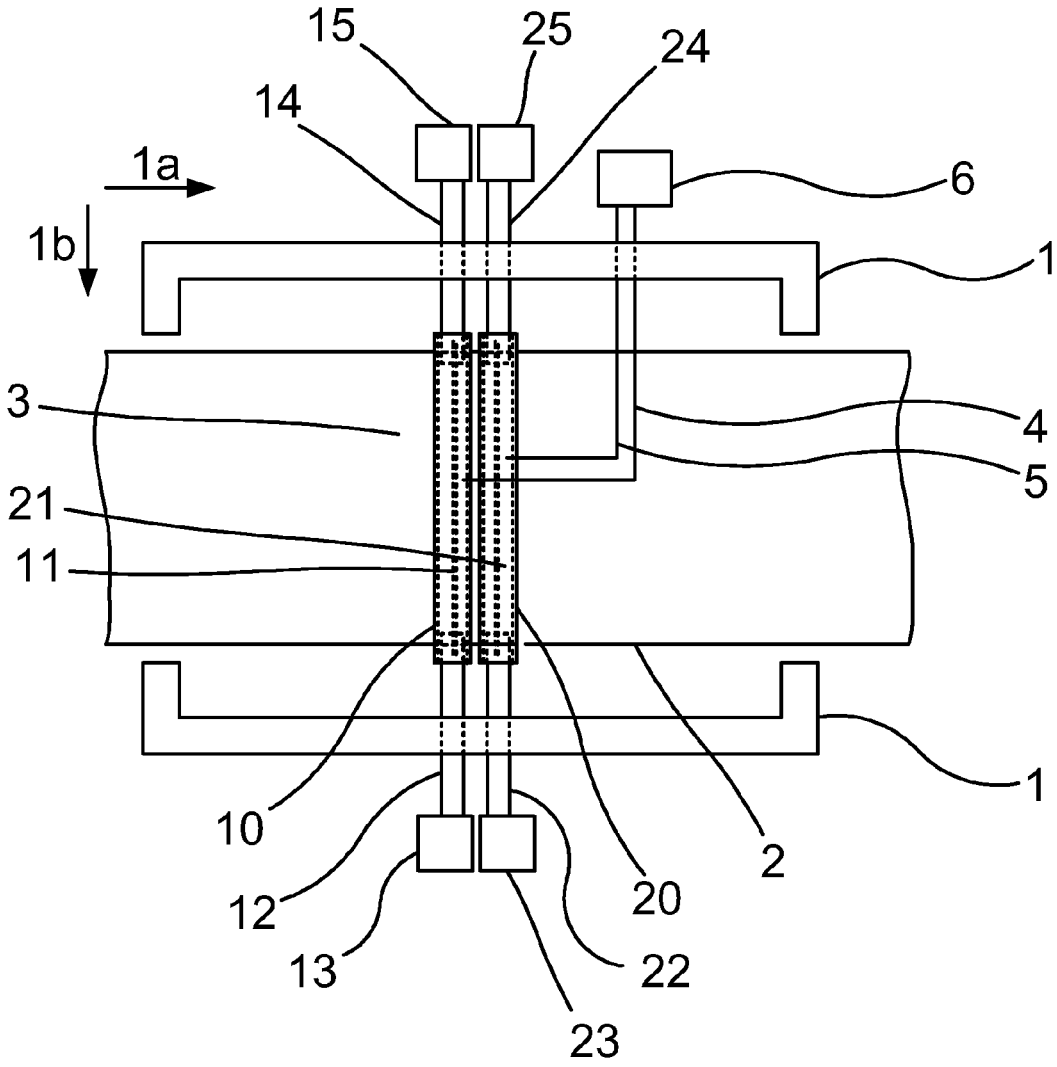
FIG. 1 is a general elevation of an industrial furnace with a burner device according to the present invention.
Figure 2:
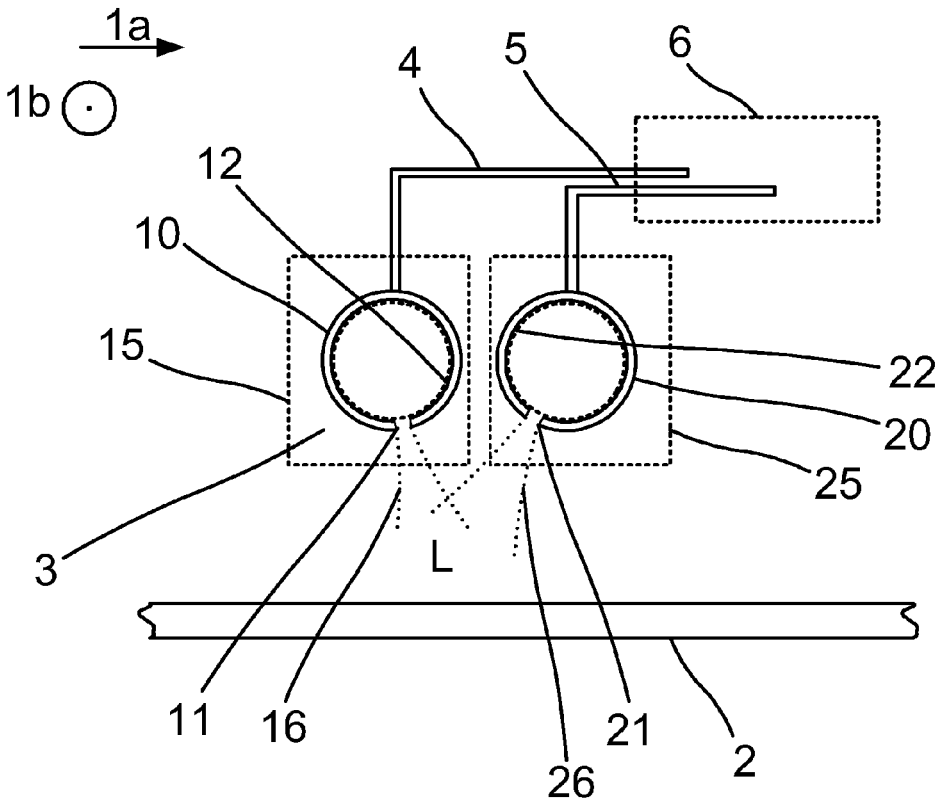
FIG. 2 is a detailed view, in cross-section from the side, which shows the burner device according to FIG. 1.

It is realised that the present invention may also be used in cases where material is not heated in an industrial furnace. In these cases a free-burning structure or a burner structure comprising radiation protection may be used, for example.

The furnace 1 contains a metal material 2 which is fed through the furnace 1 during heating. The metal material 2 may, for example, be in the form of an elongated plate, a strip or a slab, but may also assume other forms. In these cases the material 2 may have different dimensions, for example between 40 and 150 cm in width and between 1 and 500 mm in thickness, preferably between 1 and 50 mm in thickness. The length of the metal material 2 may vary between short pieces to elongated forms intended for continuous operation. Other forms of material are also conceivable. Moreover, the invention can be used for batch heating of material, and particularly useful when galvanising and when heat treating stainless metal strips.

The purpose of heating the metal material 2 may be to preheat the material 2 prior to subsequent process stages.

The industrial furnace 1 has a longitudinal direction 1*a* and a transverse direction 1*b*, which is essentially perpendicular to the longitudinal direction. The longitudinal direction 1*a* for the furnace coincides with the longitudinal direction for the metal material 2. The same applies to the transverse direction 1*b* and the transverse direction of the metal material 2.

An elongated burner device 3 of the DFI type is arranged in the furnace. The burner device may be arranged in the furnace space itself, recessed in the wall or roof of the furnace 1, or it may have another suitable location from which it can direct a flame into the furnace 1 and against the surface of the metal material 2.

The burner device 3 is fed with a gaseous fuel via a supply pipe 4 and with a gaseous oxidant via a supply pipe 5. The fuel may be propane, natural gas or any other suitable gaseous fuel. The oxidant may be oxygen enriched air. According to a preferred embodiment the oxidant consists of at least 90% by volume of oxygen gas, which increases efficiency. According to an even more preferable embodiment the oxidant consists of at least 95% by volume of oxygen gas.

The fuel and oxidant respectively flows through the pipes 4, into a fuel vessel 10 and an oxidant vessel 20, respectively. In the exemplary embodiment described, there is a single vessel 10, 20 of each type, but it is realised that more than one vessel of each type may be used, depending on the purpose of the application concerned. For example, two oxidant vessels may be used and may be arranged to enclose a fuel vessel on both sides.

The fuel vessel 10 and oxidant vessel 20 respectively are both elongated and tubular, which means that they have an elongated, hollow shape with a cross-section which may be circular, rectangular or any other suitable geometrical shape. According to a preferred embodiment, the vessels 10, have a constant, circular cross-section throughout their whole length.

The vessels 10, 20 are parallel in their principal direction of extension. Furthermore, they are orientated so that this principal direction of extension is essentially parallel to the part of the surface of the metal material 2 which is to be heat treated.

Both of the respective vessels 10, 20 are provided with openings 11, 21, which are arranged along the side of the vessel 10, 20 facing the surface of the metal material 2. The openings 11, 21 may, for example, be in the form of a series of small, homogeneously distributed holes running along the principal direction of extension of the vessel 10, 20, or a grid or some other type of perforated strip arranged as part of the wall of the vessel 10, 20. According to a preferred embodiment, and as shown in the burner device 3 illustrated in the figures, the openings 11, 21 are arranged as a coherent, longitudinal slot. The openings 11, 21 are arranged along the entire longitudinal section over which the burner device 3 is arranged to be able to heat the metal material 2. The fuel and oxidant respectively thus flows through the respective openings 11, 21 out of the fuel vessel 10 and the oxidant vessel 20 respectively. A regulator 6 is arranged to maintain a predetermined and constant pressure in each respective vessel 10, 20 by regulating the flow through the pipes 4, 5. This may be achieved, for example, by means of a feedback system (not shown).

To ensure that the regulator 6 is able to maintain the said pressure in both respective vessels 10, 20, the openings 11, 21 and the vessels 10, 20 are designed so that the dimensions of the openings 11, 21 are essentially smaller than the inside dimensions of the vessels 10, 20. According to a preferred embodiment, the width of the openings 11, 21 does not exceed 2 mm, whilst the inside diameter of each respective vessel 10, 20 is not less than 100 mm. The fact that the width of the openings 11, 21 does not exceed 2 mm means that their maximum diameter does not exceed 2 mm where a multiplicity of circular holes is used, that the width of the slot does not exceed 2 mm if a longitudinal slot is used, that the largest hole size does not exceed 2 mm if a perforated strip is used, or a corresponding dimension for other types of openings. The inner diameter of the vessel 10, is to be interpreted as the inside transverse dimension of the vessel 10, 20.

Fuel thus flows through the supply pipe 4, into the fuel vessel 10 and then out through the opening 11. Similarly, oxidant flows through the supply pipe 5, into the oxidant vessel 20 and then out through the opening 21. Because essentially the same pressure prevails throughout the fuel vessel 10, and because the slot 21 is of equal width throughout its length, the gas flow 16 through the opening 11 will be uniform along the fuel vessel 10, regardless of the length over which openings are arranged. The same applies to the oxidant.

The gas 16, 26 flowing out through the respective slot 11, 21 is arranged to be directed, by means of the orientation of the respective slot 11, 21, so that fuel and oxidant converge in an ignition zone L, in which ignition takes place and a flame is generated. To achieve this, the slots 11, 21 are directed so that the resultant gas flows 16, 26 converge. Depending among other things on the detailed design of the slots 11, 21, which influences the dispersal of both the respective gas flows 16, 26, among other things, the internal design of the furnace space in general, the degree of convection and other factors, the slots 11, 21 may, for example, be directed obliquely to each other or may be essentially parallel. According to a preferred embodiment, the slots 11, 21 are orientated so that the ignition zone L is provided between the burner device 3 and the surface of the metal material 2, the resultant flame impinging the surface directly.

Because of the elongated nature of the openings, each respective gas flow 16, 26 will form an elongated body running essentially parallel to the burner device 3, and the resultant ignition zone L and the flame generated therein will thus also be elongated. According to a preferred embodiment, the gas flows out of each individual slot 11, 21 essentially parallel, which means that the resultant ignition zone L and the flame generated therein form an essentially straight, elongated shape.

To achieve uniform heating along the surface of the metal material 2, the material 2 and the burner device 3 are arranged to be displaceable relative to one another in the longitudinal direction 1*a*. This may be realized, for example, by arranging the burner device 3 to sweep over a stationary material 2, but according to a preferred embodiment means (not shown) are arranged to convey the metal material 2 in the furnace 1, along the longitudinal direction 1*a*, past the burner device 3, which is stationarily arranged in the furnace 1. This arrangement is particularly suitable for continuous or batch heating of elongated metal products.

The burner device 3 may be orientated with its principal direction of extension essentially parallel to the transverse direction 1*b*, although other orientations are possible as long as the burner device 3 is parallel to the surface of the material 2.

For example, and as described in the Swedish patent with number 0502913-7, two burner devices (not shown) may be arranged at such a mutual angle that an arrow-shaped arrangement is formed where the tip of the arrow is directed in the longitudinal direction 1*a*. In this case the central part of the metal material 2 will be reached by the burner flames before the lateral parts are reached. The central part of the metal material 2 is thus heated before its lateral parts, given a transverse cross-section of the metal sheet 2. Compressive forces will thereby be generated in the central part of the material 2 as the annealing process advances along the longitudinal direction 1*a*. This minimises the risk of deformation during heating.

Both fuel vessel 10 and oxidant vessel 20 have open ends. At each respective end there is a piston 12, 14, 22, 24, movably inserted through the open end in question and arranged to be able to be displaced in the longitudinal direction of the respective vessel 10, 20. Each piston 12, 14, 22, 24 is also provided with sealing means (not shown) which ensure that essentially no gas can leak out of the respective vessel 10, through any of its open ends. Such sealing means may, for example, consist of male threads on the pistons 12, 14, 22, 24, which are arranged to engage in corresponding female threads in the vessel 10, 20.

Another alternative is for one or more piston rings to be arranged at the end of the piston 12, 14, 22, 24 facing into the vessel 10, 20, and for the piston rings to be arranged to bring about a sealing action between the inner surface of the vessel 10, 20 and the outer surface of the piston 12, 14, 22, 24.

A third method is to arrange O rings as sealing means.

The longitudinal position of each respective piston 12, 14, 22, 24 in the respective vessel 10, 20 is controlled by a respective control device 13, 15, 23, 25. The piston 12, 14, 22, 24 is arranged to bear in a sealing manner, from the inside of the vessel 10, 20, against the part of the openings 11, 21 that is arranged along the longitudinal section of the vessel 10, 20, along which the piston 12, 14, 22, 24 currently runs, and thereby prevent the fuel and oxidant respectively from flowing out through the openings 11, 21 along this longitudinal section. The extension of the resultant flame in transverse direction 1*b* can thereby be controlled by controlling the position of the piston 12, 14, 22, 24 in the vessel 10, 20.

Control devices 13, 15, 23, 25 may be arranged to control the position of the respective pistons 12, 14, 22, 24 in many different ways. A preferred method is to use interacting threads, as described above, which at the same time provide reliable sealing between vessels 10, 20 and pistons 12, 14, 22, 24. In this case the position of the pistons 12, 14, 22, 24 can be controlled by rotating the pistons 12, 14, 22, 24. Another preferred method is for the control devices 13, 15, 23, 25 to be arranged to slide the respective pistons 12, 14, 22, 24 along the vessel 10, 20 by means of a suitable electrically driven linear motor of prior art.

It is also possible to allow one and the same control device to control the position of more than one piston, which in some cases facilitates the adjustment of all the pistons at one end of the burner device 3 to the same position along their respective vessels.

It is clear from the figures that each respective vessel 10, has an adjustable piston 12, 14, 22, 24 at each end. It is realised, however, that this need not be the case. For example, only the open ends of each respective vessel in a burner device which faces one and the same direction may be equipped with adjustable pistons, which can be used, for example, when operating with two interacting burner ramps arranged alongside each other in the transverse direction, and where regulation of the flame extension is not required at the point where both burner ramps meet.

By controlling the position of the respective pistons 12, 14, 22, 24 in their respective vessels 10, 20, the extension of the flame along the surface of the metal material 2 is therefore controlled.

Figure 3:
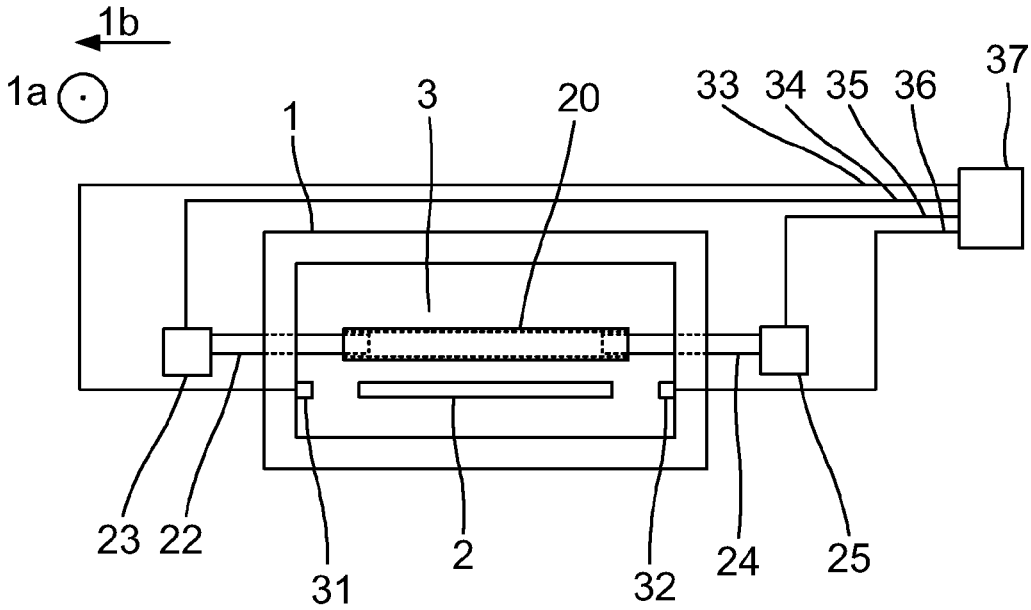
FIG. 3 is a general front view showing the burner device according to FIG. 1, together with a control system for adjusting the lateral extension of the flame during operation.

During operation the extension of the metal material 2 in the transverse direction 1*b* may vary depending, for example, on differences in dimensions along the length of the material 2 or due to movements in the transverse direction 1*b* of the material 2 as it is conveyed through the furnace 1. FIG. 3 illustrates a control system that can be used for continuously adapting the flame emitted by the burner device 3.

Thus, there are two suitable and conventional position indicators 31, 32, arranged on the inner wall of the furnace 1, on both sides of the metal material 2 in the transverse direction 1*b* and at the same height as the material 2. The position indicators 31, 32 continuously read off the position in the transverse direction 1*b* for the respective lateral edges of the metal material 2 as the material moves along the longitudinal direction 1*a*. Via cables 33 and 36 respectively, the position indicators 31, 32 transmit information on the current position of said edges to a control device 37, which in turn continuously transmits, via cables 34, 35, control signals to both respective control devices 23, 25 so that they continuously adapt the extension of the flame in the transverse direction 1*b* to correspond to the current extension of the metal material 2 in the same direction in the manner described above. The control system illustrated operates according to a suitable conventional control algorithm which means, for example, that the position indicators 31, 32 may be arranged at a certain distance in the longitudinal direction 1*a* from the burner device 3 to compensate for any delays in the system.

Several advantages are provided by the present invention.

Firstly, a more uniform heating intensity is achieved along the principal direction of extension of the burner device 3 than with conventional burner ramps because a single elongated, and evenly distributed flame is used. This results in a smoother surface of the heated material 2.

Secondly, the distance between the burner device 3 and the material 2 can be reduced without risking an uneven result, which results in increased efficiency and better utilisation of the advantages of DFI technology, as are described above.

Thirdly, it is possible, because of the possibility of continuously controlling the position of each respective piston 12, 14, 22, 24 in its respective vessel 10, 20, to regulate with greater precision the width of the part of the burner device 3 which heats the metal material 2, thereby more effectively avoiding unnecessary heating outside the width of the metal material 2 and local overheating on its edge sections.

Fourthly, the extension of the flame in transverse direction 1*b* can be continuously controlled with high precision so that it corresponds at all times to the current extension of the metal material 2 in the transverse direction 1*b* as the material 2 is conveyed through the furnace 1.

Fifthly, a simpler and cheaper burner design is achieved because it is no longer necessary to use a multiplicity of DFI burners to achieve the above purposes and because the number of components is thereby greatly reduced.

Moreover, one or more of the vessels 10, 20 may be arranged so that they can be rotated along their longitudinal axis. Because of such a rotation of one or more of the vessels 10, 20, the angle of discharge of one or more gas flows 16, 26 can also be varied and the position and/or extension of the ignition zone L can therefore be controlled.

It is thus possible, for example, by adjusting and/or fixedly arranging, the vessels 10, 20, to angle the gas flows 16, 26 somewhat obliquely relative to the normal direction of the surface of the material 2 so that the centre of the ignition zone L ends up slightly in front of or slightly behind the burner device 3 relative to the longitudinal direction 1*a*. With such an arrangement surface contaminants of the metal material 2 can be burnt off efficiently on the one hand, and on the other hand the combustion gases can be guided in a certain direction, for example out of the furnace space, thereby contributing to a more controlled circulation of gases in the furnace 1.

According to a preferred embodiment, both vessels 10, 20, are arranged at a sufficient distance from the surface of the metal material 2 for the combustion in the ignition zone L to have essentially no visible flame, which combustion is still arranged in the vicinity of the surface of the metal material 2 because both flows 16, 26 of fuel and oxidant respectively are directed, by means of the orientation of the slots 11, 21, to converge in the vicinity of said surface. In other words, the metal material 2 is in this embodiment heated by means of so-called flameless DFI. Further advantages are provided by such an arrangement. Among other things, there is a reduction in the combustion temperature which results in a lower production of noxious $NO_x$ gases, which is preferred.

Exemplary embodiments have been described above, but the invention may be varied without departing from the spirit of the same. The present invention shall therefore not be regarded as limited by these exemplary embodiments but only by the scope of the attached claims.

The invention claimed is:

1. A device for heating a metal material (2) with a longitudinal direction (1*a*) and a transverse direction (1*b*) perpendicular to the longitudinal direction (1*a*), comprising:

an elongated direct flame impingement (DFI) burner device (3) arranged to be driven with gaseous oxidant and gaseous fuel, where the metal material (2) and the burner device (3) are arranged to be displaceable relative to one another in the longitudinal direction (1*a*); and a supply device (4) for fuel and a supply device (5) for oxidant, wherein the burner device (3) comprises an elongated, tubular fuel vessel (10) and an elongated, tubular oxidant vessel (20), the respective vessels (10,20) are arranged in parallel to each other and to the surface of the metal material (2), they each have one or more openings (11,21) arranged along the vessel (10,20) through which the fuel and oxidant respectively are arranged to flow out and then converge in an ignition zone (L) outside the respective vessels (10,20) where a flame is generated, the respective supply devices (4, 5) are arranged, by means of a regulator (6), to keep the pressure in each respective vessel (10,20) constant throughout the vessel (10,20) in question during operation, and each respective vessel (10,20) comprises a piston (12,14, 22,24) which is arranged to be able to be displaced in the longitudinal direction of the vessel (10,20) and hence to prevent fuel and oxidant respectively from flowing out through openings along the longitudinal section, which openings the piston (12,14,22,24) temporarily screens from admission of fuel and oxidant, so that the propagation of the flame in the longitudinal direction of the vessels (10,20) thereby can be regulated.

2. A device according to claim 1, wherein the device is arranged in an industrial furnace (1) which in turn is arranged to heat the metal material (2) therein.

3. A device according to claim 1, wherein the openings (11,21) are designed as a coherent, elongated slot which runs along the vessel (10,20).

4. A device according to claim 1, wherein the openings (11,21) are designed as a multiplicity of openings which are evenly distributed along the vessel (10,20).

5. A device according to claim 1, wherein the openings (11,21) in each of the vessels (10,20) are arranged so that the fuel and the oxidant are brought to flow out of the respective vessels (10,20) in parallel through the openings (11,21), and so that the flows (16,26) of fuel and oxidant running parallel between themselves cross in an elongated ignition zone (L) between the burner device (3) and the surface of the metal material (2).

6. A device according to claim 1, wherein at least one of the vessels (10,20) is rotatable along its longitudinal axis, and in that the position of the ignition zone (L) can be adjusted by rotating one or more vessels (10,20).

7. A device according to claim 1, wherein each vessel (10,20) is equipped with two respective pistons (12,14,22, 24), inserted through each end of the vessel (10,20) in question, and both pistons (12,14,22,24) are together arranged to be able to control the propagation of the flame in the transverse direction (1*b*).

8. A device according to claim 7, wherein a regulator (37) is arranged continuously to control the propagation of the flame in the transverse direction (1*b*) so that it corresponds to the current extension of the metal material (2) in the transverse direction (1*b*) as the material (2) is conveyed in the longitudinal direction (1*a*) by continuously reading off the position of the material (2) in the transverse direction by means of one or more position indicators (31,32) and by continuously controlling the position of the respective pistons (12,14,22,24) based on the reading.

9. A device according to claim 1, wherein at least one piston (12,14,22,24) is designed with male threads which correspond to female threads in the vessel (10,20) associated with the piston (12,14,22,24), the interacting threads are arranged to provide a seal between the inner surface of the vessel (10,20) and the outer surface of the associated piston (12,14,22,24), and the position of the piston (12,14,22,24) in the vessel (10, 20) is therewith arranged to be adjusted by rotating the piston (12,14,22,24).

10. A device according to claim 1, wherein at least one piston (12,14,22,24) is arranged to be slid along the vessel (10,20) associated with the piston (12,14,22,24) by means of an electrically driven linear motor.

11. A device according to claim 1, wherein one or more piston rings are arranged at the end of at least one piston (12,14,22,24) facing into the corresponding vessel (10,20), and the piston rings are arranged to bring about a sealing action between the inner surface of the vessel (10,20) and the outer surface of the associated piston (12,14,22,24).

12. A device according to claim 1, wherein the width of the openings (11,21) does not exceed 2 mm and the inside diameter of each respective vessel (10,20) is not less than 100 mm.

13. A device according to claim 1, wherein the vessels (10,20) are arranged at a certain distance from the surface of the metal material (2), the slots (11,21) are orientated so that both flows (16,26) of fuel and oxidant respectively are directed to converge in the vicinity of the said surface, and the certain distance is arranged to be sufficiently large for the combustion in the ignition zone (L) to have essentially no visible flame.

14. A method for heating a metal material (2) with a longitudinal direction (1*a*) and a transverse direction (1*b*) perpendicular to the longitudinal direction (1*a*), where an elongated direct flame impingement (DFI) burner device (3) is driven by gaseous oxidant and gaseous fuel, where the metal material (2) and the burner device (3) are caused to be displaceable relative to one another in the longitudinal direction (1*a*) and where a supply device (4) for fuel and a supply device (5) for oxidant are caused to be arranged, wherein the burner device (3) is caused to have an elongated, tubular fuel vessel (10) and an elongated, tubular oxidant vessel (20), the respective vessels (10,20) are caused to be arranged parallel to one another and relative to the surface of the metal material (2), and they are each caused to have one or more openings (11,21) arranged along the vessel (10, 20) through which openings the fuel and oxidant respectively is caused to flow out and then converge in an ignition zone (L) outside the respective vessels (10,20), where a flame is generated, wherein the respective supply device (4,5) is caused, by means of a regulator (6), to keep the pressure in each respective vessel (10,20) constant throughout the vessel (10,20) in question during operation, and each respective vessel (10,20) is caused to have a piston (12,14,22,24) which is caused to be able to be displaced in the longitudinal direction of the vessel (10, 20) and hence prevent fuel and oxidant respectively from flowing out through openings along the longitudinal section, which openings the piston (12,14,22,24) temporarily screens from admitting fuel and oxidant, so that propagation of the flame in the longitudinal direction of the vessels (10,20) thereby can be controlled.

15. A method according to claim 14, wherein the metal material (2) is heated in an industrial furnace (1).

16. A method according to claim 14, wherein the openings (11,21) are caused to be designed as a coherent, elongated slot which runs along the vessel (10,20).

17. A method according to claim 14, wherein each vessel (10,20) is caused to be equipped with two respective pistons (12,14,22,24), inserted through each end of the vessel (10,20) in question, and the two pistons (12,14,22,24) are caused to be arranged together to be able to control the propagation of the flame in the transverse direction (1*b*).

18. A method according to claim 14, wherein the vessels (10,20) are caused to be arranged at a certain distance from the surface of the metal material (2), in that the slots (11,21) are orientated so that the two flows (16,26) of fuel and oxidant respectively are directed to converge in the vicinity of the said surface, and the certain distance is caused to be sufficient for the combustion in the ignition zone (L) to have essentially no visible flame.

* * * * *